US011550246B2

(12) United States Patent
Amita et al.

(10) Patent No.: US 11,550,246 B2
(45) Date of Patent: Jan. 10, 2023

(54) IMAGE FORMING APPARATUS

(71) Applicants: Akiyasu Amita, Kanagawa (JP); Tetsuo Tokuda, Tokyo (JP); Masateru Ujiie, Kanagawa (JP); Fumihiro Hirose, Kanagawa (JP); Daisuke Arai, Tokyo (JP)

(72) Inventors: Akiyasu Amita, Kanagawa (JP); Tetsuo Tokuda, Tokyo (JP); Masateru Ujiie, Kanagawa (JP); Fumihiro Hirose, Kanagawa (JP); Daisuke Arai, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/458,853

(22) Filed: Aug. 27, 2021

(65) Prior Publication Data

US 2022/0082968 A1 Mar. 17, 2022

(30) Foreign Application Priority Data

Sep. 17, 2020 (JP) ..... JP2020-156532

(51) Int. Cl.
*G03G 15/20* (2006.01)

(52) U.S. Cl.
CPC ..... *G03G 15/2039* (2013.01); *G03G 15/2057* (2013.01)

(58) Field of Classification Search
CPC ..... G03G 15/2039; G03G 15/2057
See application file for complete search history.

(56) References Cited

U.S. PATENT DOCUMENTS

2005/0211700 A1* 9/2005 Kondo ..... G05D 23/24 219/619
2012/0224878 A1* 9/2012 Ikebuchi ..... G03G 15/2039 399/70
2015/0277317 A1* 10/2015 Okabayashi ..... G03G 15/50 399/68

FOREIGN PATENT DOCUMENTS

| | | |
|---|---|---|
| JP | 2005-190765 | 7/2005 |
| JP | 2007-133292 | 5/2007 |
| JP | 2011-081223 | 4/2011 |
| JP | 2014-085579 | 5/2014 |

* cited by examiner

*Primary Examiner* — Clayton E. LaBalle
*Assistant Examiner* — Michael A Harrison
(74) *Attorney, Agent, or Firm* — Harness, Dickey & Pierce, P.L.C.

(57) ABSTRACT

An image forming apparatus includes a fixing device and circuitry. The fixing device includes a fixing rotator, an electromagnetic induction heater configured to heat the fixing rotator, and a magnetic flux control member. The circuitry is configured to control the electromagnetic induction heater to lead a temperature of the fixing rotator to a target temperature and change an upper limit of power supplied to the electromagnetic induction heater based on the target temperature.

7 Claims, 5 Drawing Sheets

| TARGET TEMPERATURE SETTING VALUE FOR COATED SHEET HAVING PAPER THICKNESS NO. 9 | MAXIMUM TURN-ON DUTY |
|---|---|
| 200°C ≥ TARGET TEMPERATURE ≥ 191°C | 56% |
| 190°C > TARGET TEMPERATURE ≥ 181°C | 69% |
| 180°C > TARGET TEMPERATURE ≥ 171°C | 84% |
| 170°C > TARGET TEMPERATURE ≥ 161°C | 84% |
| 160°C > TARGET TEMPERATURE ≥ 151°C | 94% |
| 150°C > TARGET TEMPERATURE ≥ 141°C | 94% |
| 140°C > TARGET TEMPERATURE ≥ 131°C | 100% |
| 130°C > TARGET TEMPERATURE ≥ 121°C | 100% |

IMAGE FORMING APPARATUS

CROSS-REFERENCE TO RELATED APPLICATION

This patent application is based on and claims priority pursuant to 35 U.S.C. § 119(a) to Japanese Patent Application No. 2020-156532, filed on Sep. 17, 2020 in the Japan Patent Office, the entire disclosure of which is incorporated by reference herein.

BACKGROUND

Technical Field

Embodiments of the present disclosure relate to an image forming apparatus.

Related Art

Image forming apparatuses are known that include a fixing device including an electromagnetic induction heater and a magnetic flux control member. For example, such a fixing device includes an induction heating (IH) heater as the electromagnetic induction heater that heats a heating roller around which a part of a fixing belt is wound. A magnetic flux shield as the magnetic flux control member is disposed in the hollow interior of the heating roller.

SUMMARY

This specification describes an improved image forming apparatus that includes a fixing device and circuitry. The fixing device includes a fixing rotator, an electromagnetic induction heater configured to heat the fixing rotator, and a magnetic flux control member. The circuitry is configured to control the electromagnetic induction heater to lead a temperature of the fixing rotator to a target temperature and change an upper limit of power supplied to the electromagnetic induction heater based on the target temperature.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
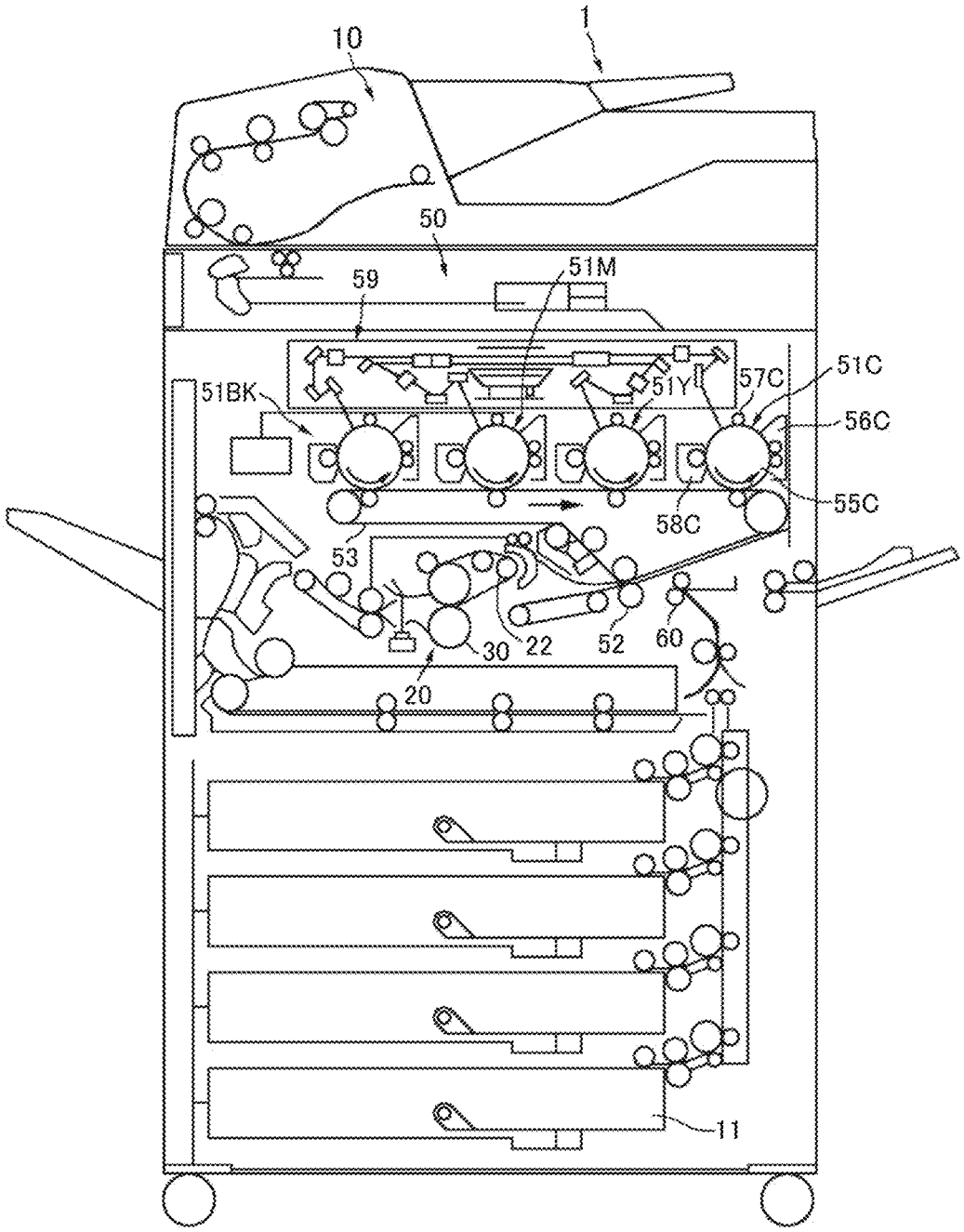
FIG. 1 is a schematic view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Referring now to the drawings, embodiments of the present disclosure are described below. As used herein, the singular forms "a," "an," and "the" are intended to include the plural forms as well, unless the context clearly indicates otherwise.

Descriptions are given of an embodiment of the present disclosure with reference to the drawings. Referring to FIG. 1, the configuration and operation of a digital copier as an image forming apparatus are described below. A main body 1 of the digital copier includes a scanner 50 that optically reads image data of a document, an automatic document feeder (ADF) 10 that continuously conveys the document to the scanner 50, an image formation section 51, and a sheet feeder 11 that stores sheets as recording media.

To form a color image, the image formation section 51 includes a black image forming unit 51BK, a magenta image forming unit 51M, a yellow image forming unit 51Y, and a cyan image forming unit 51C, which are separately disposed in the image forming apparatus. A writing unit 59 emits exposure light based on scanner image data or external image data. Since the above-described image forming units 51BK, 51M, 51Y, and 51C have the same configuration except for the difference in color, the configuration and operation of the cyan image forming unit 51C are described below. Parts in the cyan image forming unit 51C are denoted by reference numerals in FIG. 1.

In FIG. 1, a photoconductor drum 55C rotates counterclockwise. A charger 57C charges the photoconductor drum 55C, the writing unit 59 irradiates the photoconductor drum 55C with the exposure light based on cyan image data, and a developing device 56C applies cyan toner to a part of the photoconductor drum 55C that the writing unit 59 irradiates with the exposure light to form a cyan toner image. The cyan toner image is primary transferred to an intermediate transfer portion 53. Similarly, yellow, magenta, and black toner images are primary transferred to the intermediate transfer portion 53. The four color toner images are superimposed on the intermediate transfer portion 53 to form a color image. A cleaning device 58C collects residual toner on the photoconductor drum 55C after the primary transfer.

A sheet feeder 11 feeds a sheet to a registration portion 60, The registration portion 60 corrects the skew of the sheet and sends the sheet to a secondary transfer portion 52 at a timing at which the sheet meets the color toner image on the intermediate transfer portion 53. The secondary transfer portion 52 transfers the color toner image onto the sheet. After the color toner image is transferred, the sheet reaches a fixing device 20 via a conveyance path. The sheet having reached the fixing device 20 is inserted into a fixing nip between a fixing belt 22 as a fixing rotator and a pressure roller 30 as a pressure rotator, and heat from the fixing belt 22 and pressure from the pressure roller 30 fixes the color toner image onto the sheet. The sheet on which the color toner image is fixed is sent out from the fixing nip and ejected from the main body 1 as an output image. Thus, a series of image forming processes is completed.

Figure 2A:
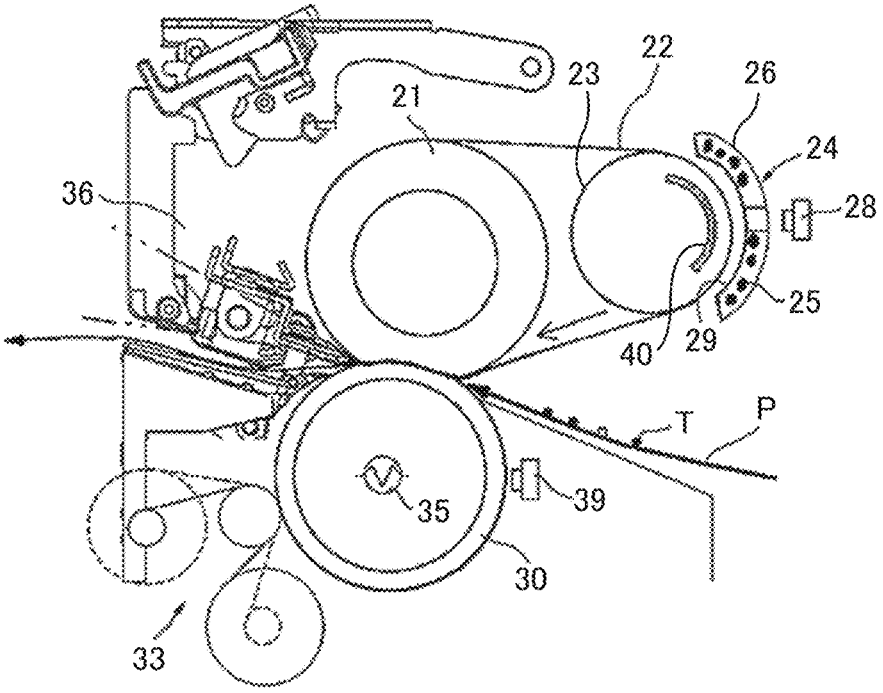
FIGS. 2A to 2C are diagrams illustrating a schematic configuration of a fixing device according to the embodiment of the present disclosure.

Referring to FIG. 2A, a description is provided of a configuration and operation of the fixing device 20 incorporated in the main body 1 of the image forming apparatus. FIG. 2A is a schematic diagram illustrating the configuration of the fixing device 20. The fixing device 20 mainly includes a fixing roller 21, a fixing belt 22, a heating roller 23, an external induction heater 24 that is an induction heating (IH) heater serving as an electromagnetic induction heater, a pressure roller 30, a separator 36, and the like.

An elastic layer made of silicone rubber or the like is formed on the surface of the fixing roller 21, and a pressure roller 30 is pressed against the outer periphery of the fixing roller 21 via the fixing belt 22 to form a fixing nip. A driver rotates the pressure roller 30 counterclockwise in FIG. 2A, and the pressure roller 30 rotates the fixing roller 21 and the fixing belt 22 because the pressure roller 30 is pressed against the fixing belt 22 and the fixing roller 21.

The fixing belt 22 is a multi-layer endless belt constructed of a base layer, an elastic layer coating the base layer, and a release layer (a surface layer) coating the elastic layer. The base layer has a layer thickness of about 90 micrometers and is made of polyimide (PI) resin. The fixing belt 22 is looped over the fixing roller 21 and the heating roller 23. The elastic layer, having a layer thickness of about 200 micrometers, is made of an elastic material such as silicone rubber, fluoro rubber, silicone rubber foam, and the like. The release layer, having a layer thickness of about 20 micrometers, is made of tetrafluoroethylene-perfluoroalkylvinylether copolymer (HA), polyimide (PI), polyether imide (PEI), polyether sulfide (PES), or the like. The release layer of the fixing belt 22 facilitates separation or peeling-off of toner of the toner image on the sheet from the fixing belt 22.

Figure 7:
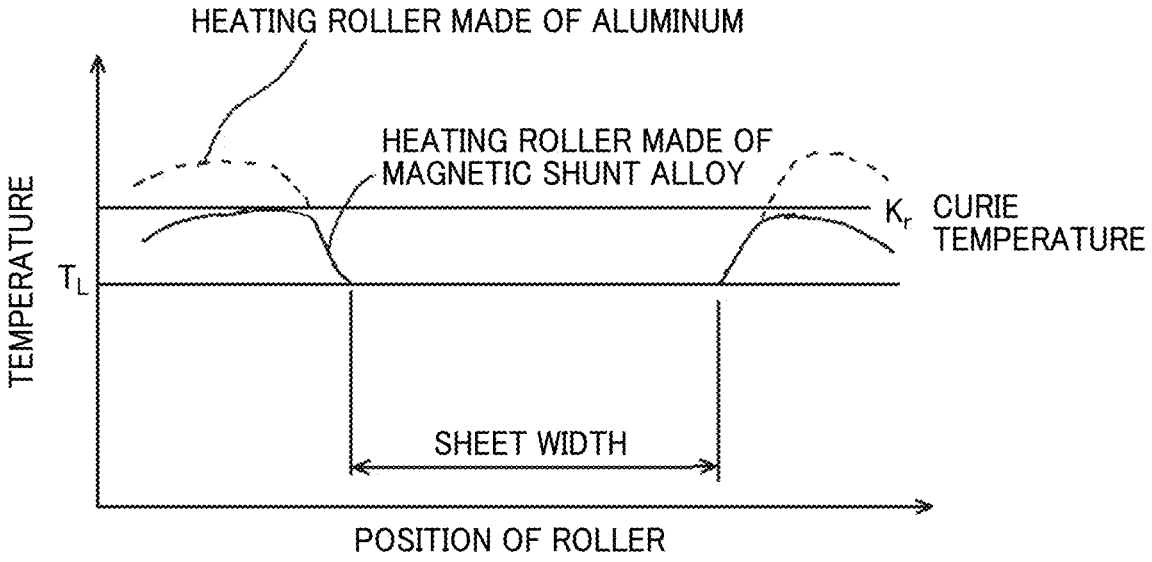
FIG. 7 is a graph illustrating temperature distribution patterns of heating rollers made of aluminum and magnetic shunt alloy.

The heating roller 23 is made of magnetic shunt alloy, functions as a heat generator, and is configured as a rotator made of magnetic shunt alloy. The heating roller 23 rotates clockwise in FIG. 2A. The magnetic shunt alloy is an iron-nickel alloy and loses magnetism at the Curie temperature. As a result, the magnetic shunt alloy has an effect that reduces heat generation and prevents temperature rise from the Curie temperature. FIG. 7 is a graph illustrating a temperature difference at end portions of the heating rollers. One of the heating rollers are made of the magnetic shunt alloy. The other one of the heating rollers is made of aluminum, and the fixing device includes a halogen heater as a heat source. When small sheets pass through the fixing device including the healing roller made of metal such as aluminum and the halogen heater, temperature of the heating roller in a non-sheet conveyance portion increases as indicated by the dashed line in FIG. 7. The non-sheet conveyance portion is an area of the heating roller that contacts a part of the fixing belt in which the small sheets do not contact. In contrast, the heating roller made of the magnetic shunt alloy and heated by the IH heater (that generates heat as the IH heater) prevents the temperature in the non-sheet conveyance portion from increasing because the magnetic shunt alloy loses the magnetism at Kr (the Curie temperature) and reduces a heat generation amount. It is not necessary to provide an extra component such as a cancel coil.

Figure 2B:
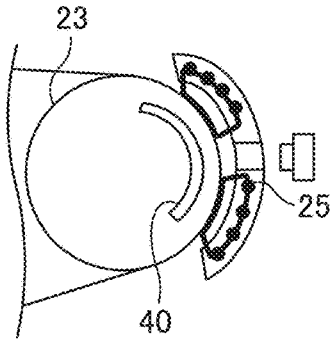
Figure 2C:
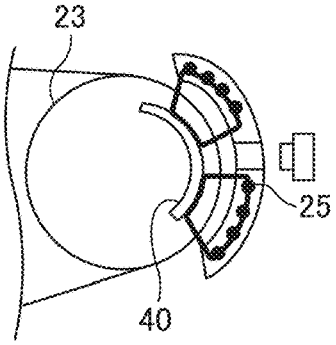

A magnetic flux control plate 40 serving as a magnetic flux control member is disposed inside the heating roller 23 so as to face a width portion of an external induction heater 24. The magnetic flux control plate 40 is made of a low-permeability material such as aluminum or copper and has a thickness of about 0.4 to 1.6 mm. The magnetic flux control plate 40 maintains a predetermined constant distance from the inner peripheral surface of the heating roller 23. The magnetic flux control plate 40 contributes to the above-described effect of the magnetic shunt alloy reducing temperature rise as follows. FIG. 2B illustrates the flow of magnetic flux when the temperature of the magnetic shunt alloy is lower than the Curie temperature. Each bold solid line represents the magnetic flux. The magnetic flux from a coil 25 flows to the heating roller 23, and the heating roller 23 generates heat. FIG. 2C illustrates the flow of magnetic flux when the temperature of the magnetic shunt alloy reaches the Curie temperature. The magnetic flux from the coil 25 passes through the heating roller 23 losing magnetism and flows through the magnetic flux control plate 40, and the heating roller 23 does not generate heat. When the temperature of the magnetic shunt alloy of the heating roller 23 exceeds the Curie temperature, the magnetic flux control plate 40 attracts the magnetic flux to the inside of the heating roller 23 so that the magnetic flux passes through the heating roller 23.

A belt configuration in which the fixing belt 22 is stretched only by the two shafts of the fixing roller 21 and the heating roller 23 can reduce a heat capacity to be smaller than a heat capacity of a belt configuration including a tension roller, which is advantageous in shortening the start-up time.

The external induction heater 24 includes a coil 25, a core 26, and a coil guide 29. The external induction heater 24 faces the heating roller 23 via the fixing belt 22 so as to partially surround the heating roller 23. The coil 25 includes a litz wire, which is a bundle of thin wires, extending in an axial direction of the heating roller 23 (that is a direction perpendicular to a paper surface of FIG. 2A) so as to cover a part of the fixing belt 22 wound around the heating roller 23. The coil guide 29 is made of a resin material or the like having high heat resistance and holds the coil 25. The core 26 is made of a material having high magnetic permeability such as ferrite. The core 26 is disposed so as to face the coil 25 extending in the axial direction of the heating roller 23. The "core portion" of the IH heater includes core portions facing each other that contribute to electromagnetic induction heating. In other words, the "core portion" of the IH heater includes the core 26 of the external induction heater 24 and the heating roller 23 made of the magnetic shunt alloy.

The pressure roller 30 includes a core and an elastic layer formed on the core and made of fluorine rubber, silicone rubber, or the like. The pressure roller 30 is pressed against the fixing roller 21 via the fixing belt 22. The pressure roller 30 can be pressed and separated from the fixing roller 21, and a cleaning device 33 is in contact with the surface of the pressure roller 30. The pressure roller 30 includes a halogen heater 35 therein. A thermistor 39 is disposed opposite the outer circumferential surface of the pressure roller 30 to detect the temperature of the pressure roller 30. A turn-on controller performs on/off control of the halogen heater 35 based on the temperature detected by the thermistor 39.

The fixing device 20 includes a guide plate disposed near an entry of the fixing nip to guide the sheet P conveyed to the fixing nip. The fixing nip is a contact portion between the fixing belt 22 and the pressure roller 30. The fixing device 20 includes a separator 36 disposed near an outlet of the fixing nip. The separator 36 includes a separation plate to separate the sheet from the fixing belt 22 and guide the sheet conveyed from the fixing nip.

A non-contact temperature detection sensor 28 is disposed near the external induction heater 24 to detect a surface temperature (that is a fixing temperature) of the fixing belt 22 wound around the heating roller 23. Using results detected by the sensor 28, a heater controller controls the IH heater in the fixing device 20 to control the fixing temperature.

The fixing device 20 configured as described above operates as follows. As the pressure roller 30 is driven to rotate, the pressure roller 30 rotates the fixing roller 21 and the fixing belt 22 in a direction indicated by arrow in FIG. 2A, and the heating roller 23 also rotates clockwise. A high-frequency alternating current supplied to the coil 25 generates eddy currents on a surface of the heating roller 23. The eddy currents and an electrical resistance of the heating roller 23 generate Joule heat. The Joule heat heats the fixing belt 22 wound around the heating roller 23 in a portion facing the external induction heater 24. The fixing belt 22 heated as described above reaches the fixing nip. On the other hand, the sheet P bearing the totter image T formed by the above-described image forming process is fed into the fixing nip while being guided by the guide plate. In the fixing nip, the toner image T receives heat from the fixing belt 22 and pressure from the pressure roller 30, the heat melts toner of the toner image T, and the pressure is applied to the toner image T on the sheet P. Thus, the toner image T is fixed on the sheet P. The sheet P is sent out from the fixing nip.

Figure 3:
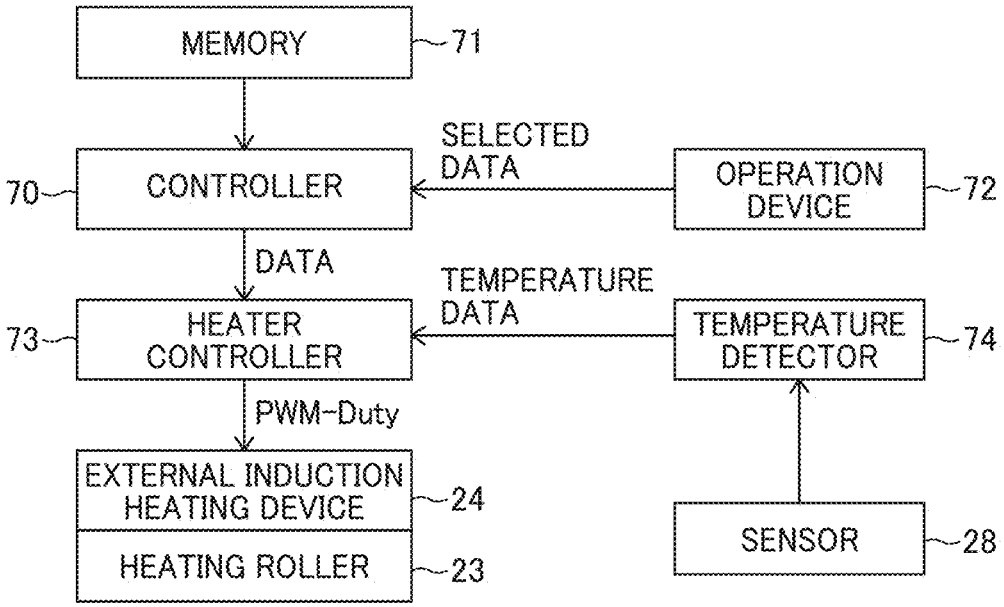
FIG. 3 is a block diagram illustrating electronical components of the image forming apparatus of FIG. 1.

The following describes a temperature control of the IH heater in the fixing device 20. FIG. 3 is a block diagram illustrating a functional configuration of electronical components of the image forming apparatus that includes the fixing device 20 including the IH heater. The controller 70 includes a central processing unit (CPU) or the like and accesses an external memory 71 that stores an execution program and a parameter table. In addition, the controller 70 acquires selected data such as data about a selected sheet and data about a selected process speed that defines a sheet conveyance speed in the fixing device from an operation device 72. The controller 70 also acquires parameters relating to operations in the fixing device 20 from the external memory 71 as necessary based on the selected data from the operation device 72. The controller 70 sends the acquired parameter data to the heater controller 73.

The heater controller 73 acquires temperature data from a temperature detector 74 that detects the temperature of the fixing belt 22 from the output of the temperature detection sensor 28. The heater controller 73 determines a ratio of a pulse width to be applied to the external induction heater 24 with respect to the maximum pulse width based on the temperature data and the parameter data related to the operations in the fixing device 20. The parameter data is sent from the controller 70. Hereinafter, the ratio is referred to as "PWM-Duty". Specifically, as the detected temperature is lower than a target temperature and the difference between the detected temperature and the target temperature is larger, the heater controller 73 sets the PWM-Duty so that power suppled to the external induction heater 24 is larger. The PWM-Duty corresponds to a ratio of the supplied power to the maximum power consumption of the external induction heater 24. The heater controller 73 sets the obtained PWM-Duty to supply power to the external induction heater 24.

The heater controller 73 uses a pulse-width modulation (PWM) control method to change the PWM-Duty and control power supplied to the external induction heater 24 to perform a temperature control. Specifically, based on the PWM-Duty, a pulse having a pulse width of several milliseconds to several tens of milliseconds is applied to the external induction heater 24. The PWM-Duty is set such that a current flowing through the external induction heater 24 changes linearly. The heater controller 73 controls the PWM-Duty so that the temperature of the fixing belt is a predetermined temperature.

The external induction heater 24 in FIG. 3 includes a rectifier circuit and an inverter circuit that is a high-frequency generation circuit. The rectifier circuit rectifies an alternating current from a commercial power supply 31 (AC100V) and inputs a direct current to the inverter circuit. In the inverter circuit, the coil 25 is connected in parallel with the resonance capacitor to form an LC resonance circuit. The inverter circuit includes a switching element that turns on and off at a high frequency to generate a high-frequency current and supplies the high-frequency current to the coil 25. In the external induction heater 24, a drive signal corresponding to the set PWM-Duty drives the switching element.

The maximum power consumption in the temperature control may not be set to be the maximum power consumption of the external induction heater 24. For example, an image forming apparatus using the IH heater has a limit of rated 1000 W. When a load other than the IH heater consumes power corresponding to 200 W, the heater controller 73 controls the IH heater as a heater having a rated maximum power consumption 800 W even if the IH heater has the rated maximum power consumption 1000 W. The above-described control can satisfy the limit of the rated 1000 W of the entire image forming apparatus.

The above-described fixing device includes the heating roller as a heat generator in which the electromagnetic induction heater generates heat and the magnetic flux control member facing the electromagnetic induction heater via the heating roller. The heating roller is made of magnetic shunt alloy. A large electric power supplied to the electromagnetic induction heater raises the temperature of the heating roller, reduces the magnetic permeability of the magnetic shunt alloy, and the magnetic flux passes through the heating roller having lost magnetism and flows through the magnetic flux control member, thereby generating an eddy current in the magnetic flux control member. The eddy current flowing through the magnetic flux control member causes the magnetic flux control member to generate heat. The heat generated in the magnetic flux control member may cause the temperature of the magnetic flux control member to rise above the expected temperature, that is, the heat-resistant temperature, degrade the magnetic flux control member, and change the shape of the magnetic flux control member. Unexpected thermal expansion of the magnetic flux control member may cause the magnetic flux control member to contact a component near the magnetic flux control member and cause deformation of the component.

Figure 4:
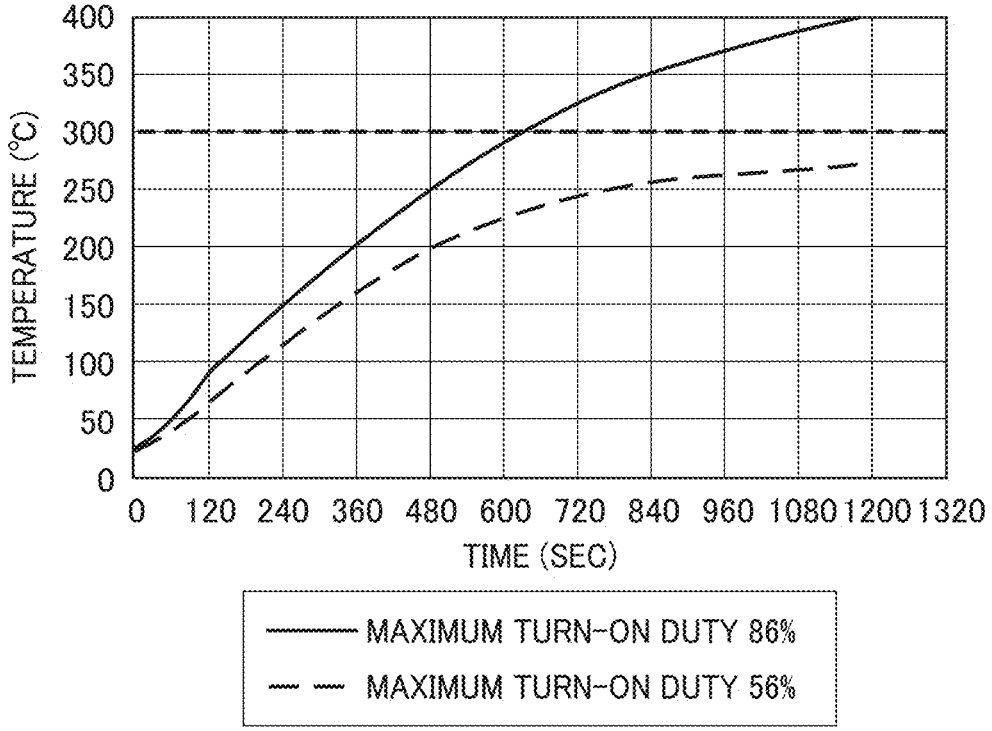
FIG. 4 is a graph illustrating results of experiments.

FIG. 4 is a graph illustrating transitions of the temperature rises of the magnetic flux control plate 40 when coated sheets having a paper thickness No. 9 continuously pass through the fixing device, and when the target temperature is set to 200° C. The sheet having the paper thickness No. 9 has a paper weight from 300 g/m$^2$ to 350 g/m$^2$. In FIG. 4, there are two characteristic curves. The characteristic curve drawn by a solid line and disposed at an upper portion of FIG. 4 indicates temperature measurement results of the magnetic flux control plate 40 when the heater controller 73 sets a maximum turn-on duty to 86%. The characteristic curve drawn by a dashed line and disposed at a lower portion indicates temperature measurement results of the magnetic flux control plate 40 when the heater controller 73 sets the maximum turn-on duty to 56%. The maximum turn-on duty is the maximum value of the PWM-Duty applied to the external induction heater 24 in the block diagram of FIG. 3 regardless of the detected temperature. In other words, the maximum turn-on duty is a value of the PWM-Duty corresponding to the upper limit of the electric power supplied to the electromagnetic induction heater according to the target temperature of a heating target that is the fixing belt 22.

As is clear from FIG. 4, the temperature of the magnetic flux control plate 40 increases over time while the sheets continuously pass through the fixing device. When the maximum turn-on duty is set to 86%, the temperature rises to 400° C. In contrast, when the maximum turn-on duty is set to 56%, the temperature rises to 273° C. As can be seen from this, the temperature of the magnetic flux control plate 40 increases as the maximum turn-on duly increases. Therefore, reducing the maximum turn-on duty lowers the temperature of the magnetic flux control plate 40.

Figures 5, 6:
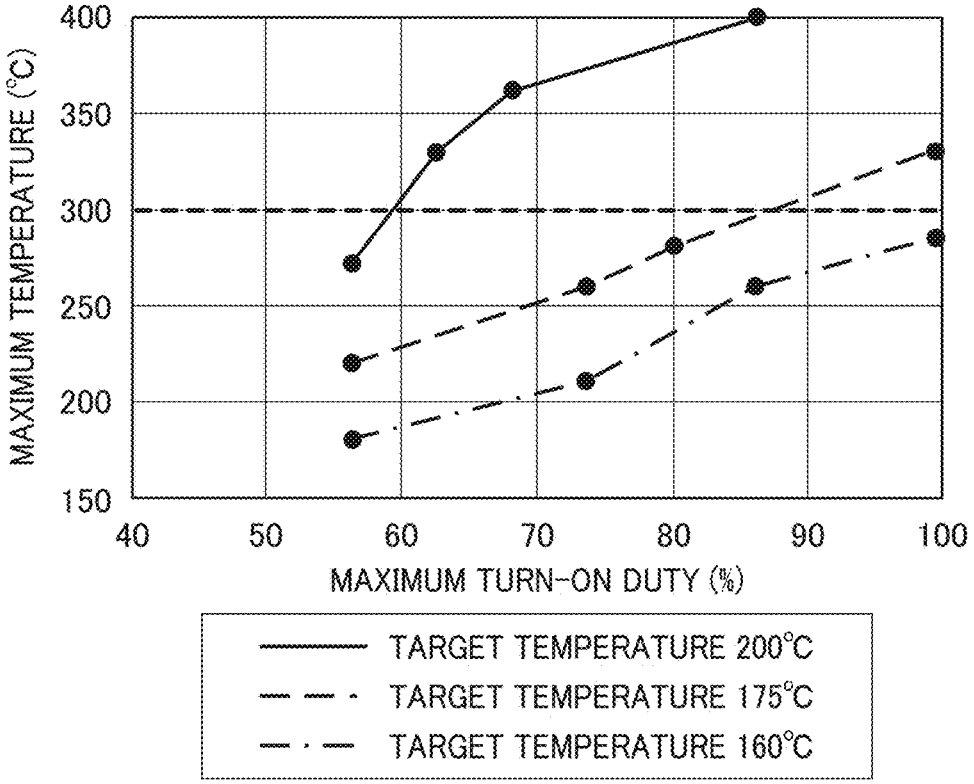
FIG. 5 is a graph illustrating results of other experiments.
FIG. 6 is an example of a table of setting values.

FIG. 5 is a graph illustrating relations between the maximum turn-on duties as illustrated in FIG. 4 and the maximum temperatures of the magnetic flux control plate 40 while the sheets continuously pass through the fixing device in different target temperatures of the fixing belt. As indicated by the uppermost solid line, when the target temperature of the fixing belt is 200° C., the temperature of the magnetic flux control plate 40 reaches 400° C. at the maximum turn-on duty 86% while the sheets continuously pass through the fixing device. In contrast, the temperature of the magnetic flux control plate 40 does not rise relatively when the target temperature is 175° C., as illustrated by a broken line in a middle portion of FIG. 5 and when the target temperature is 160° C., as illustrated by an alternate long and short dash line in the lower portion of FIG. 5. For example, when the target temperature is 160° C., the temperature of the magnetic flux control plate 40 reaches 260° C. at the maximum turn-on duty 86%.

As described above, the higher the set target temperature is, the higher the temperature of the magnetic flux control plate 40 is. Accordingly, setting the maximum turn-on duty to be low when the target temperature is set to be high enables to prevent the temperature of the magnetic flux control plate 40 from increasing. When the target temperature is set to be low, the maximum turn-on duty may be set to be high because the temperature of the magnetic flux control plate 40 does not relatively rise. Setting the maximum turn-on duty to be high improves an ability that the temperature of the fixing belt quickly reaches to the target temperature, prevents the temperature of the fixing belt from dropping, and improves the productivity because a copy speed does not need to be reduced to maintain a fixing property.

FIG. 6 is an example of a table of the target temperatures set for the coated sheet having the paper thickness No. 9 and the maximum turn-on duties each of which is set corresponding to a range of the target temperatures. The higher the target temperature is, the lower the maximum turn-on duly is set, and the lower the target temperature is, the higher the maximum turn-on duty is set.

Although the table of FIG. 6 is set for the coated sheet having the paper thickness No. 9, such a table may be set more precisely, for example, set for various types of sheet (ex. a non-coated sheet, a coated sheet, and the like), and set for various paper thickness (ex. the paper thickness No. 1 to No. 9). Setting tables as described above can prevent the temperature of the magnetic flux control plate 40 from increasing in various cases. Additionally, tables as described above may be more precisely set for various process linear velocities (ex. a standard velocity, a medium velocity, a low velocity, etc.). Setting tables as described above can prevent the temperature of the magnetic flux control plate 40 from increasing in various cases. In principle, the process linear velocity is the velocity of the sheet passing through the fixing device.

As a result, the above-described embodiments can reduce the deformation of the magnetic flux control member caused by the temperature rise.

The table as illustrated in FIG. 6 is stored in the external memory 71 illustrated in FIG. 3 and is used for setting the PWM-Duty for the external induction heater 24 that is controlled by the controller 70 and the heater controller 73.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Each of the functions of the described controller in the present embodiments may be implemented by one or more processing circuits or circuitry. Processing circuitry includes a programmed processor, as a processor includes circuitry. A processing circuit also includes devices such as an application specific integrated circuit (ASIC), a digital signal processor (DSP), a field programmable gate array (FPGA), and conventional circuit components arranged to perform the recited functions.

What is claimed is:

1. An image forming apparatus comprising:

a fixing device including a fixing rotator, an electromagnetic induction heater configured to heat the fixing rotator, and a magnetic flux control member; and circuitry configured to, control the electromagnetic induction heater to lead a temperature of the fixing rotator to a target temperature, and change an upper limit of power supplied to the electromagnetic induction heater, based on the target temperature by selecting the upper limit of the power corresponding to the target temperature from among a plurality of upper limits of the power corresponding to respective ones of a plurality of target temperatures such that the upper limit of the power that is selected is smaller than another one of the plurality of upper limits of the power corresponding to another one of the plurality of target temperatures lower than the target temperature.

2. The image forming apparatus according to claim 1, further comprising:

a temperature detection sensor configured to detect the temperature of the fixing rotator, wherein the circuitry is configured to change the power supplied to the electromagnetic induction heater, based on the target temperature and a temperature detected by the temperature detection sensor.

3. The image forming apparatus according to claim 1, wherein the circuitry comprises:

a memory configured to store the plurality of target temperatures, including the target temperature, and the plurality of upper limits of the power corresponding to the plurality of target temperatures.

4. The image forming apparatus according to claim 1, wherein the circuitry is configured to set the target temperature based on a type of a sheet passing through the fixing device.

5. The image forming apparatus according to claim 1, wherein the circuitry is configured to set the target temperature based on a velocity of a sheet passing through the fixing device.

6. The image forming apparatus according to claim 1, wherein the circuitry is configured to perform a pulse-width modulation control and change an upper limit of a pulse width controlled by the pulse-width modulation control to change the upper limit of the power.

7. The image forming apparatus of claim 1, wherein the fixing rotator is wound about a heat generator, the heat generator being made of a magnetic shunt alloy, wherein the magnetic flux control member is inside the heat generator.

* * * * *